US010453629B2

(12) United States Patent
Nan et al.

(10) Patent No.: US 10,453,629 B2
(45) Date of Patent: Oct. 22, 2019

(54) CONTACTOR AND CONTACTOR SYSTEM

(71) Applicant: Sooar (Beijing) Investment Management Group Co., Ltd., Beijing (CN)

(72) Inventors: Yin Nan, Beijing (CN); Congli Wang, Beijing (CN); Mingliang Zhang, Beijing (CN); Lingqian Meng, Beijing (CN)

(73) Assignee: Sooar (Beijing) Investment Management Group Co., Ltd., Beijing (CN)

( * ) Notice: Subject to any disclaimer, the term of this patent is extended or adjusted under 35 U.S.C. 154(b) by 197 days.

(21) Appl. No.: 15/571,170

(22) PCT Filed: Dec. 30, 2015

(86) PCT No.: PCT/CN2015/099753
§ 371 (c)(1),
(2) Date: Nov. 1, 2017

(87) PCT Pub. No.: WO2016/177009
PCT Pub. Date: Nov. 10, 2016

(65) Prior Publication Data

US 2018/0061591 A1 Mar. 1, 2018

(30) Foreign Application Priority Data

May 5, 2015 (CN) ..... 2015 1 0224939

(51) Int. Cl.

| | |
|---|---|
| ***H01H 9/34*** | (2006.01) |
| ***H01H 50/54*** | (2006.01) |
| ***H01H 9/38*** | (2006.01) |

(52) U.S. Cl.
CPC ..... *H01H 9/34* (2013.01); *H01H 9/38* (2013.01); *H01H 50/54* (2013.01); *H01H 2235/01* (2013.01)

(58) Field of Classification Search
CPC H01H 9/34; H01H 9/38; H01H 50/54; H01H 2235/01
See application file for complete search history.

(56) References Cited

U.S. PATENT DOCUMENTS 3,555,471 A * 1/1971 Mitskevich et al. ..... H01H 1/24 335/195
4,039,983 A * 8/1977 Terracol ..... H01H 9/38 335/16
4,421,959 A 12/1983 Chen et al.

FOREIGN PATENT DOCUMENTS

CN 101217076 A 7/2008
CN 104779120 A 7/2015
CN 204632678 U 9/2015

OTHER PUBLICATIONS

PCT International Search Report for PCT/CN2015/099753, dated Mar. 14, 2016, 13 pages.

(Continued)

*Primary Examiner* — Mohamad A Musleh
(74) *Attorney, Agent, or Firm* — Law Offices of Liaoteng Wang

(57) ABSTRACT

A contactor and a contactor system are provided. The contactor comprises: a fixed contact; a movable contact capable of moving towards or away from the fixed contact; two arc ignition sheets for the movable contact, being positioned respectively at two sides opposite to each other of the movable contact in a first direction and fixed and electrically connected to the movable contact; two arc ignition sheets for the fixed contact, being positioned respectively at two sides opposite to each other of the fixed contact (Continued)

in the first direction and fixed and electrically connected to the fixed contact; and two arc-extinguishing chambers being arranged respectively on extension lines extending from the movable contact to the two arc ignition sheets for the movable contact in the first direction, wherein the two arc ignition sheets for the movable contact form an incomplete encirclement for the movable contact.

10 Claims, 7 Drawing Sheets

(56) References Cited

OTHER PUBLICATIONS

First Office Action dated Jun. 3, 2016 and first Search Report in Chinese Patent Application No. 201510224939.0, and concise English-language summary thereof, 6 pages.

* cited by examiner

CONTACTOR AND CONTACTOR SYSTEM

CROSS-REFERENCE TO RELATED APPLICATIONS

This application is a National Stage of International Application No. PCT/CN2015/099753, filed on Dec. 30, 2015, which claims priority to Chinese Patent Application No. 201510224939.0, filed on May 5, 2015, both of which are hereby incorporated by reference in their entireties.

TECHNICAL FIELD

The present disclosure relates to contactors, and more particularly, to a contactor for use in a place in which both operation frequency and operation number of the contactor are low. The contactor according to an embodiment of the present disclosure is applicable to a control circuit of an electric motor. Embodiments of the present disclosure also relate to a contactor system including the contactor.

BACKGROUND

A contactor, as a widely used control component, is mainly used in a control circuit to switch on/off a circuit remotely and control start/stop of an electric motor, and may constitute a motor starter with an appropriate thermal relay or an electric protection device to protect a circuit in which overloading may occur. The contactor may be used in light industrial, metallurgical, chemical, coal mine, mechanical, hoisting, railway, shipbuilding and communication industries.

CN Utility Patent Application CN2091028U (Patent Document 1) discloses a vacuum magneto control point contactor comprising a vacuum seal cavity and a coil outside the vacuum seal cavity.

CN Utility Patent Application CN2342458Y (Patent Document 2) discloses a three-phase AC three-pole single-break point direct-driving contactor having three movable contacts and three fixed contacts corresponding to the three movable contacts in position.

CN Invention Patent Application CN101017740A (Patent Document 3) discloses a relay comprising a body, a movable contact and a fixed contact on the body, and an iron grating sheet for arc-extinguishing between the movable contact and the fixed contact nearby a moving direction line of the movable contact.

SUMMARY

An embodiment of the present disclosure provides a contactor comprising: a fixed contact; a movable contact capable of moving towards or away from the fixed contact; two arc ignition sheets for the movable contact, being positioned respectively at two sides opposite to each other of the movable contact in a first direction and fixed and electrically connected to the movable contact; two arc ignition sheets for the fixed contact, being positioned respectively at two sides opposite to each other of the fixed contact in the first direction and fixed and electrically connected to the fixed contact; and two arc-extinguishing chambers being arranged respectively on extension lines extending from the movable contact to the two arc ignition sheets for the movable contact in the first direction, wherein the two arc ignition sheets for the movable contact form an incomplete encirclement for the movable contact and the incomplete encirclement has a gap in a direction substantially orthogonal to the first direction.

Another embodiment of the present disclosure provides a contactor comprising: a fixed contact; a movable contact capable of moving towards or away from the fixed contact; two arc ignition sheets for the movable contact, being positioned respectively at two sides opposite to each other of the movable contact in a first direction and fixed and electrically connected to the movable contact; two arc ignition sheets for the fixed contact, being positioned respectively at two sides opposite to each other of the fixed contact in the first direction and fixed and electrically connected to the fixed contact; two arc-extinguishing chambers being arranged respectively on extension lines extending from the movable contact to the two arc ignition sheets for the movable contact in the first direction; and a contact support provided with a cavity therein, the movable contact and the fixed contact being arranged in the cavity.

A yet another embodiment of the present disclosure provides a contactor system comprising the contactor and a control device for controlling the contactor to be closed or opened.

DETAILED DESCRIPTION

Exemplary embodiments of the present disclosure will be illustrated in detail below in combination with accompany drawings and specific embodiments.

Figure 1:
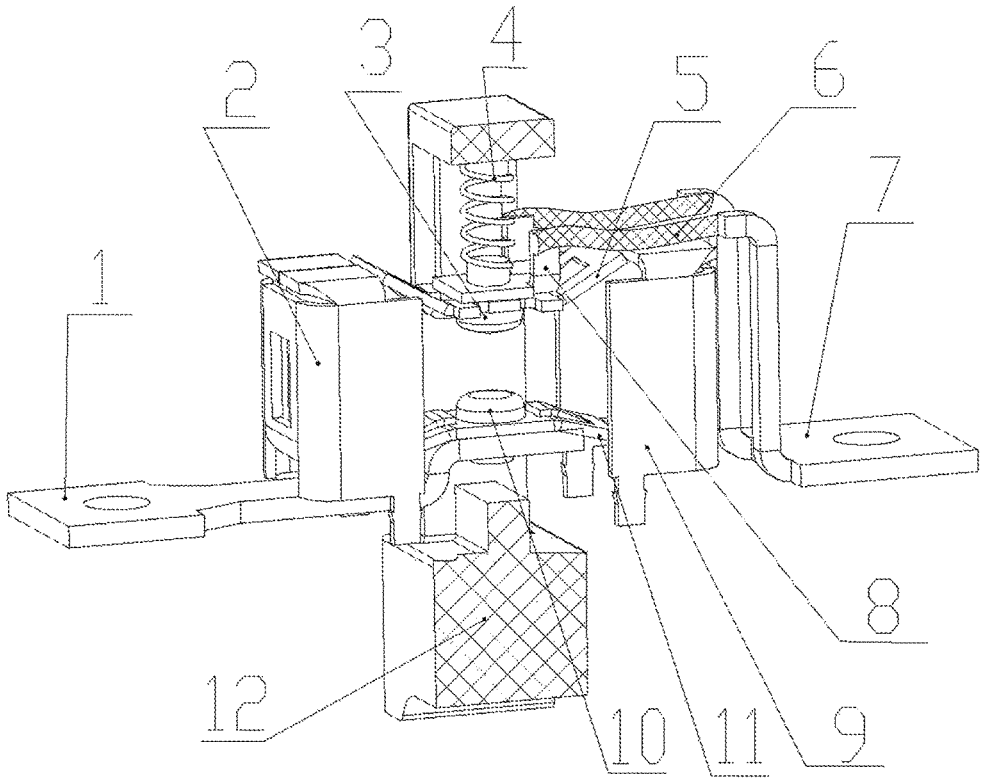
FIG. 1 is a perspective diagram of a contactor according to an exemplary embodiment of the present disclosure.
Figure 2:
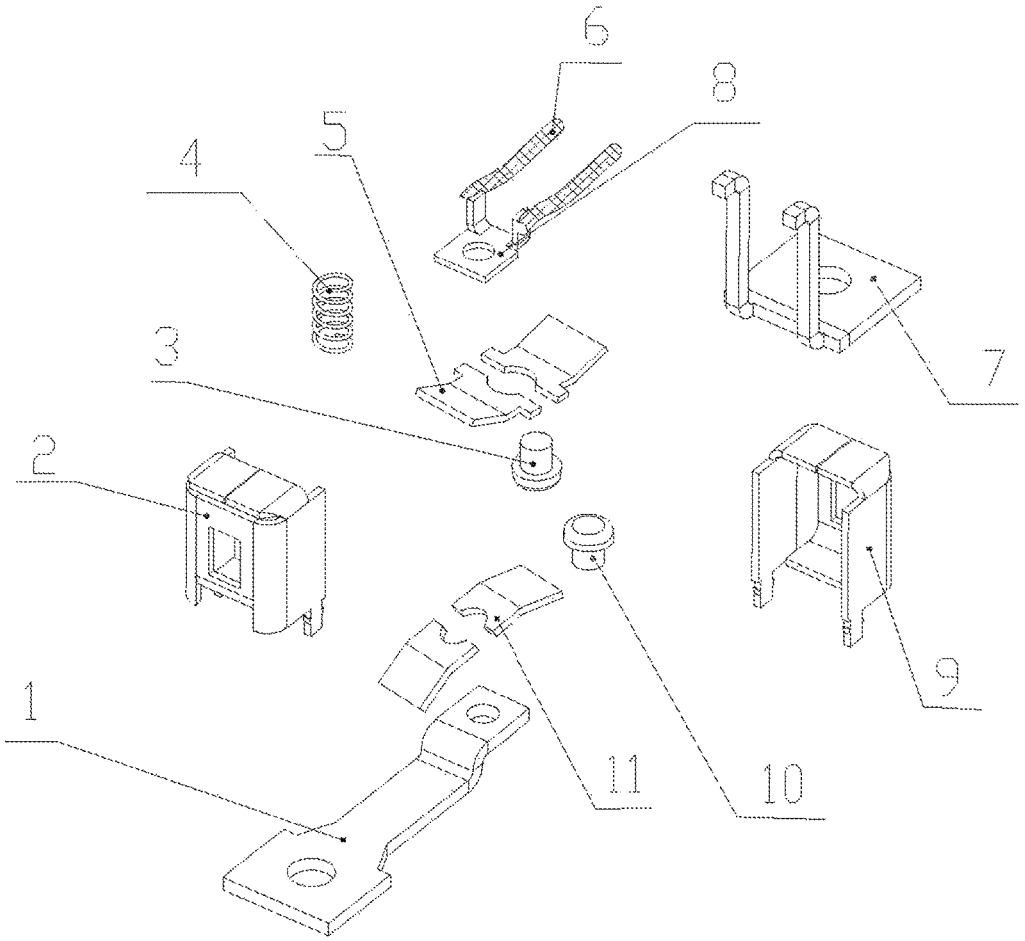
FIG. 2 is a decomposition diagram of components except for a contact support in the contactor shown in FIG. 1.

FIG. 1 is a perspective diagram of a contactor 100 according to an exemplary embodiment of the present disclosure. FIG. 2 is a decomposition diagram of components except for a contact support 12 in the contactor 100 shown in FIG. 1. As shown in FIG. 1, the contactor 100 may include at least some of the following components: a fixed contact wiring terminal 1, a left arc-extinguishing chamber 2, a movable contact 3, a movable contact spring 4, two arc ignition sheets 5 for the movable contact, a soft connection line 6, a movable contact wiring terminal 7, a movable contact-contact plate 8, a right arc-extinguishing chamber 9, a fixed contact 10 and two arc ignition sheets 11 for the fixed contact.

Figure 4:
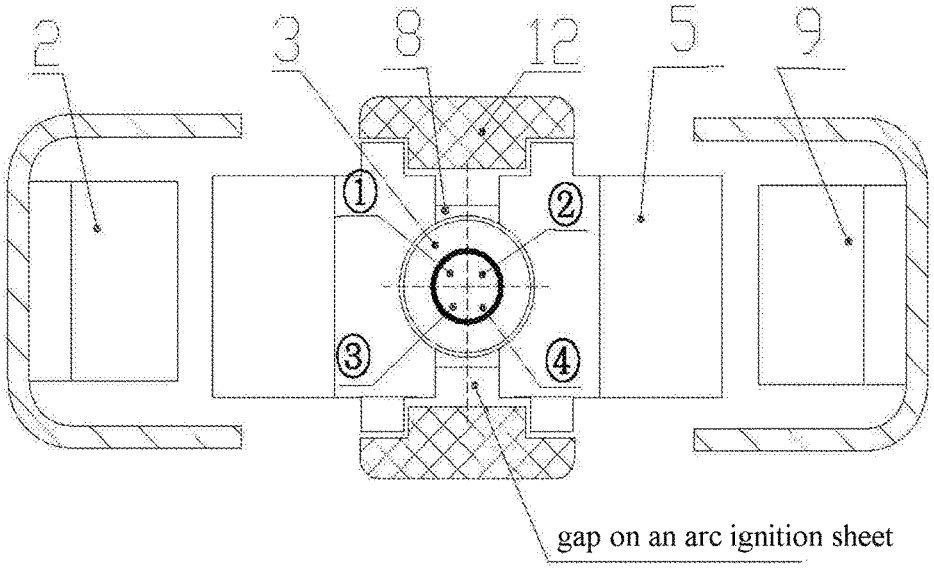
FIG. 4 is a top view of the embodiment shown in FIG. 1, illustrating an arc-extinguishing structure associated with a movable contact.

As shown in FIG. 1, according to the embodiment, the movable contact 3, the movable contact-contact plate 8 and the arc ignition sheets 5 for the movable contact may be stacked and fixed together via for example, riveting, welding and clamping and so on; the fixed contact 10, the arc ignition sheets 11 for the fixed contact and the fixed contact wiring terminal 1 may also be stacked and fixed together via for example, riveting, welding and clamping and so on. As shown in FIG. 4, the left arc-extinguishing chamber 2 and the right arc-extinguishing chamber 9 are provided on extension lines extending from the movable contact 3 to respective arc ignition sheets 5 for the movable contact (or extending from the fixed contact 10 to respective arc ignition sheets 11 for the fixed contact), respectively. However, the above arrangement is merely an example. In additional to electrically connecting and fixing the movable contact 3 and the arc ignition sheets 5 for the movable contact by means of the movable contact-contact plate 8, the movable contact 3 and the arc ignition sheets 5 for the movable contact may also be electrically connected and fixed in another way; similarly, in addition to electrically connecting and fixing the fixed contact 10 and the arc ignition sheets 11 for the fixed contact by means of the fixed contact wiring terminal 1, the fixed contact 10 and the arc ignition sheets 11 for the fixed contact may also be electrically connected and fixed in another way.

In order to ensure that there is good electrical conductivity between the movable contact 3 and the movable contact wiring terminal 7 and the movable contact 3 may move up and down along with the contact support 12, according to the embodiment, the soft connection line 6 may be used as a current path, wherein one terminal of the soft connection line is connected to an end of the movable contact-contact plate 8 via for example, riveting or welding and the other terminal of the soft connection line is connected to the movable contact wiring terminal 7 via for example, riveting or welding.

A cavity is provided within the contact support 12, the movable contact 3 and the fixed contact 10 may be placed within the cavity, and a guide groove provided within the cavity may ensure that the movable contact 3 moves towards or away from the fixed contact 10 within the contact support 12. The arc ignition sheets 5 for the movable contact and the arc ignition sheets 11 for the fixed contact may introduce electrical arcs produced when the movable contact 3 and the fixed contact 10 are disconnected from each other into the left arc-extinguishing chamber 2 and the right arc-extinguishing chamber 9 respectively to extinguish the electrical arcs. The left arc-extinguishing chamber 2 and the right arc-extinguishing chamber 9 are provided with an exhaust port in a direction deviating from the movable contact 3 (or the fixed contact 10).

Figure 3:
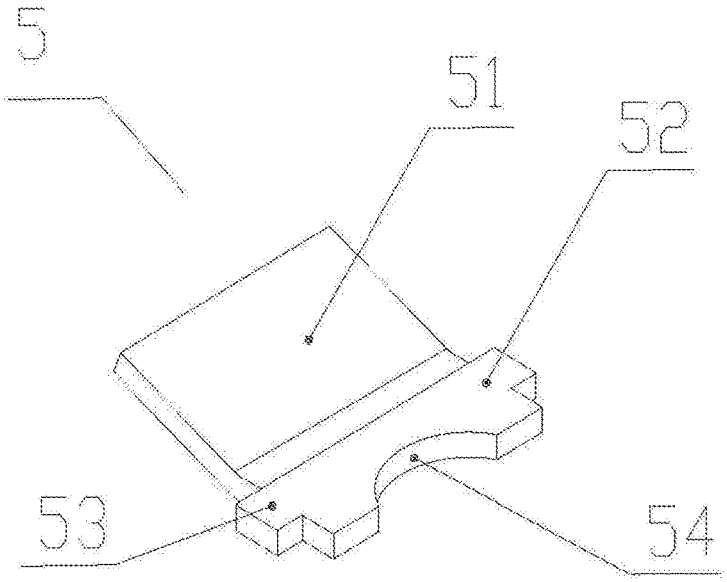
FIG. 3 is a structure diagram of an arc ignition sheet for a movable contact according to an exemplary embodiment of the present disclosure.

FIG. 3 illustrates a structure of the arc ignition sheet 5 for the movable contact according to an exemplary embodiment of the present disclosure. The arc ignition sheet 5 for the movable contact is provided with bumps 52 and 53, which may coordinate with the guide groove within the contact support 12 to enable the arc ignition sheet 5 for the movable contact, along with the movable contact 3, move along the guide groove. The arc ignition sheet 5 for the movable contact is also provided with a structure 54 matching with an outer shape of the movable contact 3. Although the arc ignition sheet 5 for the movable contact shown in FIG. 3 further includes a bending part 51, the art ignition sheet 5 for the movable contact may be flat as a whole in other embodiments. Furthermore, although the structure 54 is a circular arc in FIG. 3, this is merely exemplary; when the movable contact 3 has another shape, the structure may have a corresponding shape complementary to the shape of the movable contact 3. The arc ignition sheet 5 for the movable contact may be made of magnetic materials.

FIG. 4 is a top view of the embodiment shown in FIG. 1, illustrating an arc-extinguishing structure associated with the movable contact in the embodiment. As shown in FIG. 4, the two arc ignition sheets 5 for the movable contact are positioned respectively at two sides opposite to each other of the movable contact in a first direction (i.e., a horizontal direction in the figure), and the two arc ignition sheets 5 for the movable contact do not entirely encircle the movable contact 3, i.e. there is a gap between the two arc ignition sheets 5 for the movable contact in a direction orthogonal to a connecting line between the left and right arc-extinguishing chambers 2 and 9 (i.e., near the contact support 12). As the arc ignition sheets 5 for the movable contact are fixed on the movable contact 3 and thus form a whole with the movable contact 3, no matter which one of areas ①, ②, ③ and ④ shown in FIG. 4 a contact position between the movable contact and the fixed contact lies in, the electrical arcs will move in a direction near the arc ignition sheet 5 for the movable contact having less magnetic resistance and thus are introduced into the arc-extinguishing chamber 2 or 9 to be cooled and extinguished, so that a duration in which the electrical arcs stay on the movable and fixed contacts is reduced. In an embodiment in which the arc ignition sheets 5 for the movable contact are made of magnetic materials, the magnetic resistance between the movable contact 3 and the arc ignition sheet 5 for the movable contact is much smaller than that at the gap, so it is ensured that the electrical arcs produced when the movable contact and the fixed contact are disconnected from each other will move towards the arc ignition sheet 5 for the movable contact with smaller magnetic resistance under Ampere force. Moreover, setting the gap between the arc ignition sheets for the movable contact may effectively avoid introducing the electrical arcs to the contact support 12 and thus mitigate burnout of the contact support 12. The electrical arcs may be quickly and effectively introduced into the left and right arc-extinguishing chambers 2 and 9 and thus be cooled and extinguished by providing the two arc ignition sheets 5 for the movable contact. According to another embodiment, the gap between the two arc ignition sheets 5 for the movable contact may be filled with another materials, for example, high magnetic resistance materials or high-temperature-resistant materials.

As shown in FIGS. 1-2, left and right sides of the fixed contact 10 are both provided with an arc ignition sheet 11 for the fixed contact, and the arc ignition sheet 11 for the fixed contact may have a similar structure as the arc ignition sheet 5 for the movable contact. The two arc ignition sheets 11 for the fixed contact do not entirely encircle the fixed contact 10, i.e., there is a gap near the contact support 12 between the two arc ignition sheets 11 for the fixed contact. The arc ignition sheets 11 for the fixed contact may also be made of magnetic materials. The arc ignition sheet 11 for the fixed contact may be provided with bumps corresponding to the bumps 52 and 54 on the arc ignition sheet 5 for the movable contact, or may be provided with no bump.

Figure 5:
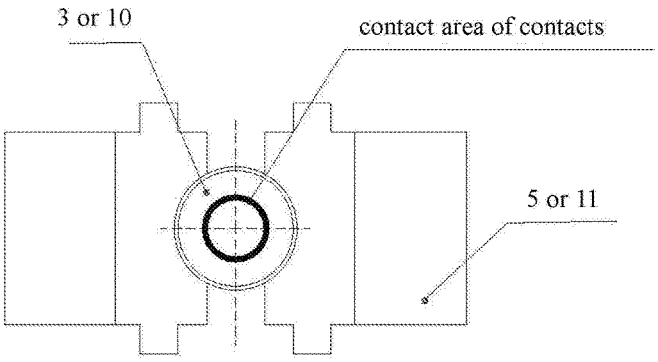
FIG. 5 illustrates a positional relationship between a movable contact and arc ignition sheets for the movable contact in the embodiment shown in FIG. 4.

FIG. 5 illustrates a positional relationship between the movable contact 3 and the arc ignition sheets 5 for the movable contact in the embodiment shown in FIG. 4 more clearly, the positional relationship also applicable to the fixed contact 10 and the arc ignition sheets 11 for the fixed contact. As shown in FIG. 5, when the movable contact 3 is placed within the cavity of the contact support 12 and moves in the guide groove along with the contact support 12 (in a direction vertical to paper), the contact position between the movable contact 3 and the fixed contact 10 when they are connected with each other is closer to a central area, i.e., a desired position scope. According to embodiments of the present disclosure, this may reduce a center deviation between the movable contact 3 and the fixed contact 10, ensure a maximum contact area between the movable contact 3 and the fixed contact 10, and thus reduce contact resistance, temperature increase and power consumption.

Figure 6:
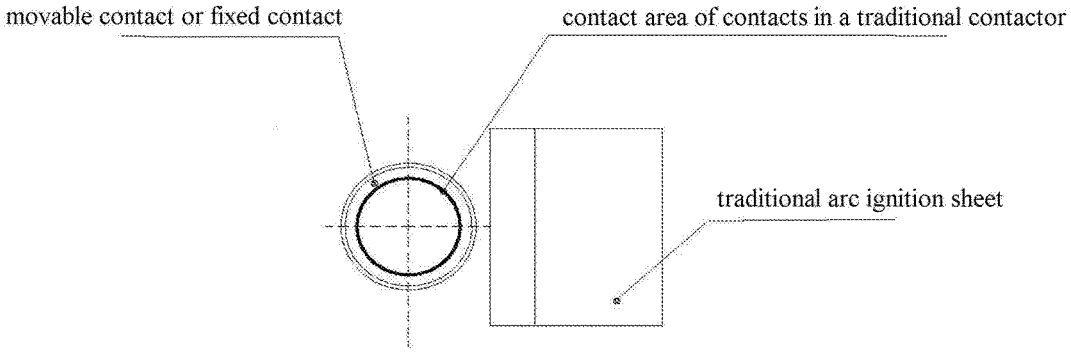
FIG. 6 illustrates a positional relationship between a movable contact and arc ignition sheets for the movable contact in a comparative example.

FIG. 6 illustrates a comparative example in a similar way as shown in FIG. 5, wherein only one arc ignition sheet is provided in the comparative example. In the comparative example shown in FIG. 6, when the movable contact and the fixed contact are connected with each other, as compared with the embodiment shown in FIG. 3, the contact position between the movable contact and the fixed contact is more disperse and farther away from center positions of the fixed and movable contacts. This may result in a larger center deviation, reduce the contact area between the movable and fixed contacts, and thus increase contact resistance, temperature increase and power consumption.

Figure 7:
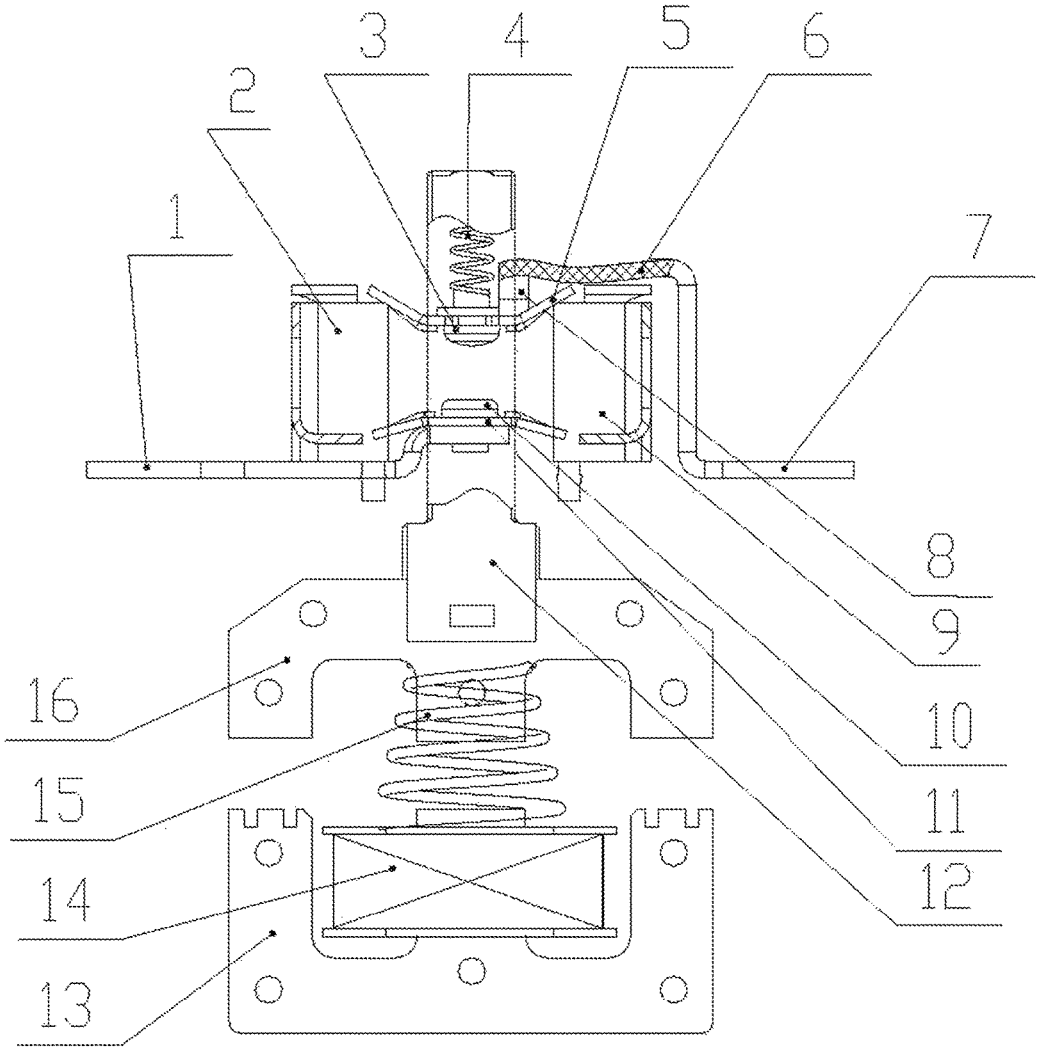
FIG. 7 illustrates a contactor system in which a movable contact and a fixed contact are disconnected from each other according to an exemplary embodiment of the present disclosure.
Figure 8:
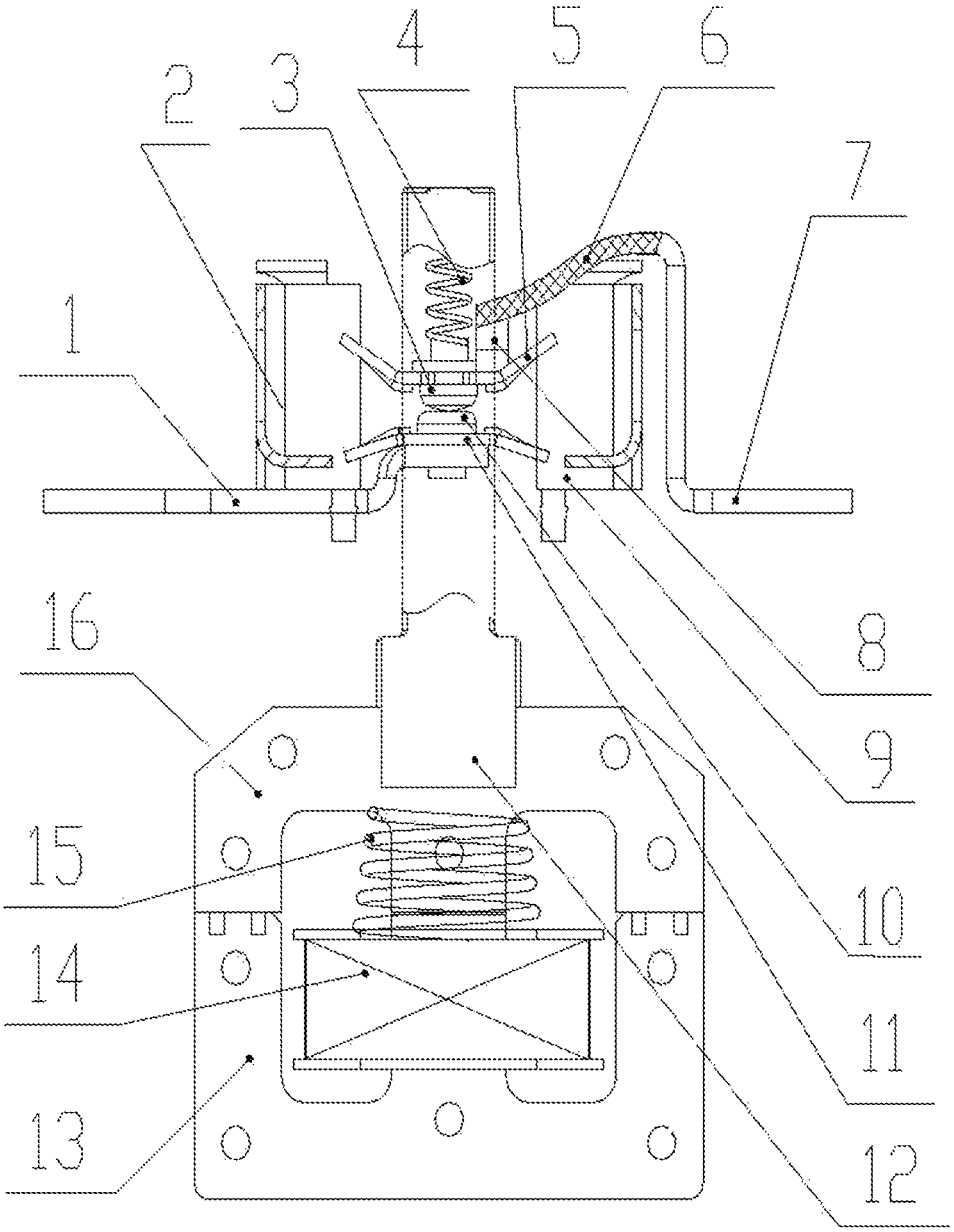
FIG. 8 illustrates a contactor system in which a movable contact and a fixed contact are connected with each other according to an exemplary embodiment of the present disclosure.

FIGS. 7-8 illustrate a contactor system according to an exemplary embodiment of the present disclosure, wherein the contactor system includes the contactor 100 and a control device for controlling the contactor to be closed or opened. In the embodiment shown in FIGS. 7-8, the control device includes a movable core 16, a fixed core 13, a reaction spring 15 and a control coil 14, wherein the energizing and deenergizing of the control coil is controlled from external of the contactor system. The contact support 12 is connected to the movable core 16. FIG. 7 illustrates a working condition in which the movable contact 3 and the fixed contact 10 are disconnected from each other. FIG. 8 illustrates a working state in which the movable contact 3 and the fixed contact 10 are connected with each other.

The movable contact 3 and the fixed contact 10 of the contactor 100 are placed within the cavity of the contact support 12. When the control coil 14 is not energized, due to the function of the reaction spring 15, there is a distance between the movable core 16 and the fixed core 13 and the contact support 12 connected with the movable core 16 also maintains a distance, which is a contact distance of the contactor 100, between the movable contact 3 and the fixed contact 10.

When the control coil 14 is energized, with magnetic excitation produced by the control coil 14, an electromagnetic attraction force is produced between the movable core 16 and the fixed core 13, the movable core 16 overcomes a counter force of the reaction spring 15 and moves downwards and brings the contact support 12 to move downwards, and the contact support 12 brings the movable contact 3 to move downwards, so that the movable contact 3 and the fixed contact 10 are connected with each other. Then, the movable core 16 continues to bring the contact support 12 to move downwards, and the movable contact 3 slides along the guide groove in the cavity of the contact support 12 until the movable core 16 and the fixed core 13 are completely connected with each other.

As elastic deformation occurs in the movable contact spring 4 when the movable contact 3 and the fixed contact 10 are connected with each other, a pressure (i.e., a final pressure) and an over stroke are produced between the movable contact 3 and the fixed contact 10.

Through the above process, the contactor 100 switches on a circuit from the fixed contact wiring terminal 1 to the movable contact wiring terminal 7, so that an electrical equipment, for example, a motor is switched on and starts operating.

When the control coil 14 is deenergized, the magnetic excitation of the control coil 14 disappears, the electromagnetic attraction force between the movable core 16 and the fixed core 13 disappears, the movable core 16 pushes the contact support 12 to move upwards under the function of the reaction spring 16, and the movable contact 3 slides along the guide groove in the cavity of the contact support 12, so that the movable contact 3 and the fixed contact 10 are disconnected from each other. After the contact support 12 moves upwards a certain distance (i.e., the contact distance), the movable contact and the fixed contact return to the disconnected state shown in FIG. 7.

Through the above process, the contactor 100 switches off the circuit from the fixed contact wiring terminal 1 to the movable contact wiring terminal 7, so that the electrical equipment, for example, the motor is switched off and stops operating.

When the movable contact 3 and the fixed contact 10 are disconnected from each other, the electric arcs may be produced and then may be introduced to the left arc-extinguishing chamber 2 and the right arc-extinguishing chamber 9 quickly via the arc ignition sheets 5 for the movable contact and the arc ignition sheets 11 for the fixed contact to be cooled and extinguished.

With respect to arc-extinguishing effect and electrical life of the contactor, the inventor researches various structure combinations of the arc ignition sheets and the arc-extinguishing chambers and verifies six arc-extinguishing solutions. The arc-extinguishing effect and electrical life of the contactor in the six arc-extinguishing solutions under a same rated voltage, current, frequency and power factor are the following:

① More than 500 thousands of experiments are performed for the contactor including the left and right arc ignition sheets and the left and right arc-extinguishing champers according to the embodiment shown in FIG. 1, wherein the contact support 12 and surfaces of the movable contact 3 and the fixed contact 7 have slight burning losses, and the soft connection line 6, the movable contact wiring terminal 7 and the fixed contact wiring terminal 1 have no burning loss.

② Sixty thousands of experiments are performed for the contactor in which the arc ignition sheet and the arc-extinguishing chamber on one side as shown in FIG. 1 are canceled and only the arc ignition sheet and the arc-extinguishing chamber on the other side as shown in FIG. 1 are preserved, wherein the surfaces of the movable contact 3 and the fixed contact 7 have serious burning losses, there is no over stroke, the contact support 12, the soft connection line 6 and the movable contact wiring terminal 7 have burning losses, and the fixed contact wiring terminal has no burning loss, so the contactor cannot be used any longer.

③ Forty thousands of experiments are performed for the contactor in which the arc-extinguishing chamber on one side as shown in FIG. 1 is canceled and the arc ignition sheets on both sides and the arc-extinguishing chamber on the other side as shown in FIG. 1 are preserved, wherein the surfaces of the movable contact 3 and the fixed contact 7 have serious burning losses and adhesions, there is no over stroke, the soft connection line 6 has serious burning losses, the contact support 12 and the movable contact wiring terminal 7 have burning losses, and the fixed contact wiring terminal 1 has no burning loss, so the contactor cannot be used any longer.

④ Ten thousands of experiments are performed for the contactor in which the arc-extinguishing chambers on both sides shown in FIG. 1 are canceled and the arc ignition sheets on both sides shown in FIG. 1 are preserved, wherein the surfaces of the movable contact 3 and the fixed contact 7 have serious burning losses and adhesions, the soft connection line 6 has serious burning losses, the contact support 12, the movable contact wiring terminal 7 and the fixed contact wiring terminal 1 have burning losses, so the contactor cannot be used any longer.

⑤ Eight thousands of experiments are performed for the contactor in which the arc ignition sheets on both sides shown in FIG. 1 are canceled and only the arc-extinguishing chambers on both sides shown in FIG. 1 are preserved, wherein the surfaces of the movable contact 3 and the fixed contact 7 have serious burning losses and more than ⅔ of the surfaces of the movable contact 3 and the fixed contact 7 have abrasions, there is no over stroke, the contact support 12 and the soft connection line 6 have serious burning losses, the movable contact wiring terminal 7 and the fixed contact wiring terminal 1 have no burning losses, so the contactor cannot be used any longer.

⑥ Five thousands of experiments are performed for the contactor in which all the arc ignition sheets and all the arc-extinguishing chambers shown in FIG. 1 are canceled, wherein the surfaces of the movable contact 3 and the fixed contact 7 have serious burning losses and adhesions, the contact support 12 and the soft connection line 6 have burning losses, the movable contact wiring terminal 7 and the fixed contact wiring terminal 1 have slight burning losses, so the contactor cannot be used any longer.

As indicated by the above experiments, the contactor with the arc ignition sheets and the arc-extinguishing chambers on both sides has great advantages in the electrical life and the arc-extinguishing effect.

Figure 9:
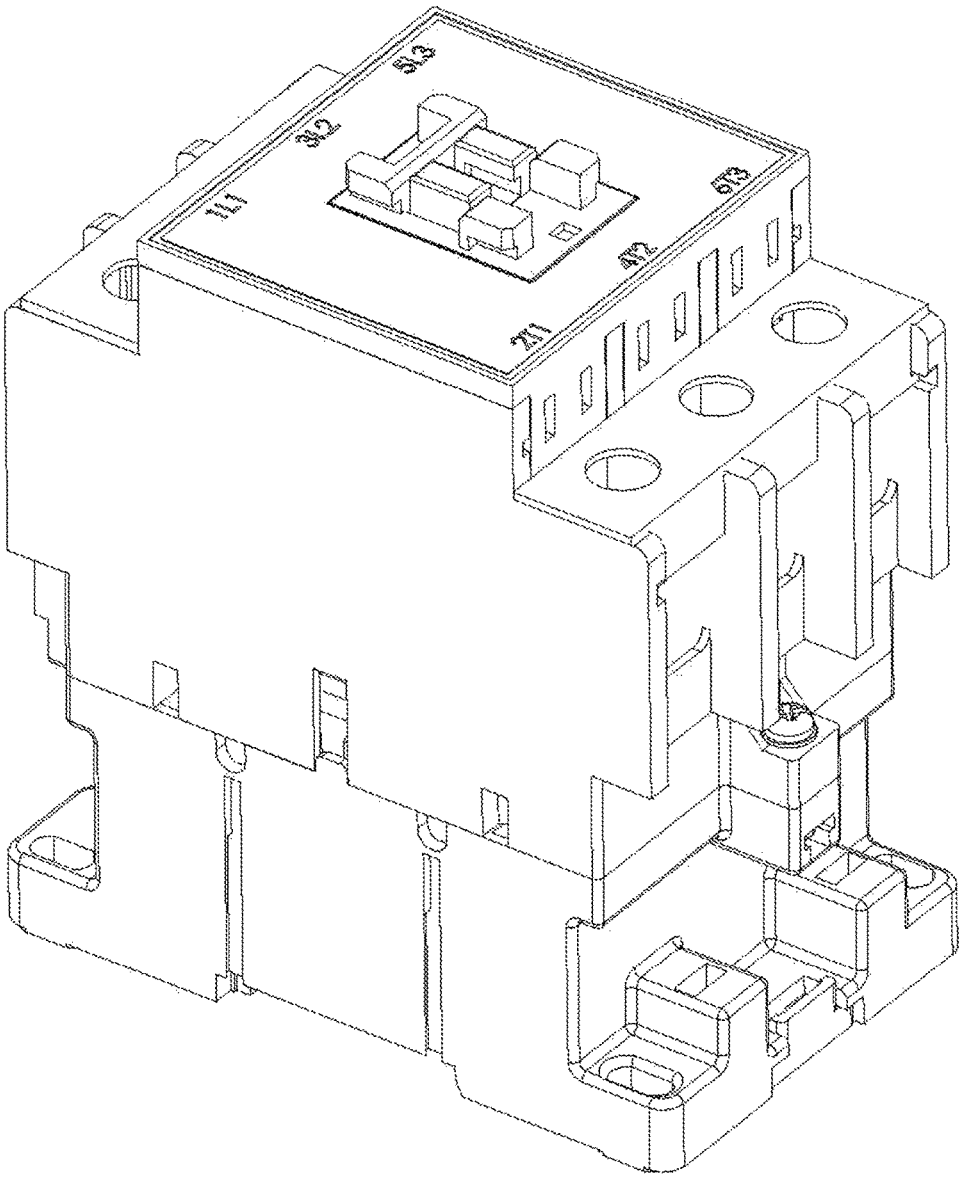
FIG. 9 illustrates an overall appearance diagram of a product obtained by placing a contactor system in a housing according to an exemplary embodiment of the present disclosure.

FIG. 9 illustrates an overall appearance diagram of a product obtained by placing a contactor system in a housing according to an exemplary embodiment of the present disclosure.

According to the embodiment of the present disclosure, the movable contact and the fixed contact of the contactor are placed within the cavity of the contact support, and the cavity moves along with the contact support. As compared with the contactor disclosed in Patent Document 1, the contactor according to the embodiment of the present disclosure has a smaller volume, so the manufacturing materials are saved and the manufacturing cost is reduced.

According to the embodiment of the present disclosure, the movable contact of the contactor moves in the cavity of the contact support. As compared with the contactor disclosed in Patent Document 2, the moving trail of the movable contact is more exact, and the contact position between the movable contact and the fixed contact when they are connected with each other is closer to a central area in theory, so the center deviation is reduced when the movable contact and the fixed contact are connected with each other, a maximum contact are is ensured, and the contact resistance, the temperature increase and the power consumption are reduced.

Furthermore, usually, the contact support and the contacts are designed in clearance fit with each other in the contactor. As abrasions are inevitable in the use of the contactor, the gap between the contact support and the contacts will become larger and larger as the action number of the contactor increases. The gap between the contact support and the contacts and influences of gravity and the reaction spring will lead to an uncertainty of the contact position between the movable contact and the fixed contact when they are connected with each other, i.e. uncertainties in arc root position and act motion direction of the electric arcs produced when the movable contact and the fixed contact are disconnected from each other.

According to the embodiment of the present disclosure, the contactor includes the arc ignition sheets on both side (i.e. the arc ignition sheets for the movable contact and the arc ignition sheets for the fixed contact), wherein: the two arc ignition sheets for the movable contact are positioned respectively at both sides of the movable contact, and the two arc ignition sheets for the movable contact do not entirely encircle the movable contact, i.e., there is a gap on each side near the contact support, and the arc ignition sheets for the movable contact form a whole structure with the movable contact; the two arc ignition sheets for the fixed contact are positioned respectively at both side of the fixed contact, and the two arc ignition sheets for the fixed contact do not entirely encircle the fixed contact, i.e., there is a gap on each side near the contact support, and the arc ignition sheets for the fixed contact form a whole structure with the fixed contact. As compared with the relay disclosed in Patent Document 3, the electric arcs produced when the movable contact and the fixed contact are disconnected from each other may be introduced to the arc-extinguishing chambers quickly and effectively to be cooled and extinguished.

According to the embodiment of the present disclosure, the arc ignition sheets are made of magnetic materials, so that the magnetic resistances between the movable contact and the arc ignition sheet for the movable contact and between the fixed contact and the arc ignition sheet for the fixed contact are much smaller than those at the gaps. In one embodiment, simulation indicates that the latter is more than 3000 times of the former. When the movable contact and the fixed contact are disconnected from each other so that the electric arcs are produced, the electric arcs move towards the arc ignition sheet having smaller magnetic resistance under Ampere force. Introducing the electric arcs to the arc ignition sheets may reduce the duration in which the electric arcs stay on the movable and fixed contacts. Setting the gap between the arc ignition sheets for the movable contact may effectively avoid introducing the electrical arcs to the contact support and thus mitigate burnout of the contact support. The structure including the arc ignition sheets on both sides and the arc-extinguishing chambers on both sides (i.e., the left arc-extinguishing chamber and the right arc-extinguishing chamber) may introduce the electric arcs into the arc-extinguishing chambers quickly and effectively via the arc ignition sheets to cool and extinguish the electric arcs.

An embodiment of the present disclosure provides a method for manufacturing the contactor 100, the method including steps S1-S4.

In step S1, the movable contact 3 and the two arc ignition sheets 5 for the movable contact are fixed together to form a movable contact body, wherein the two arc ignition sheets 5 for the movable contact are positioned respectively at left and right sides of the movable contact 3, and they do not entirely encircle the movable contact 3, i.e. the arc ignition sheet 5 for the movable contact has a gap near the contact support 12. For example, the arc ignition sheets 5 for the movable contact may be fixed on the movable contact-contact plate 8, which may be fixed to the movable contact 3. The movable contact-contact plate 8 may be connected with the movable contact wiring terminal 7 via the soft connection line 6.

In step S2, the fixed contact 10 and the two arc ignition sheets 11 for the fixed contact are fixed together to form a fixed contact body, wherein the two arc ignition sheets 11 for the fixed contact are positioned respectively at left and right sides of the fixed contact 10 and they do not entirely encircle the fixed contact 10, i.e., the arc ignition sheet 11 for the fixed contact has a gap near the contact support 12. For example, the arc ignition sheets 11 for the fixed contact may be fixed on the fixed contact wiring terminal 1, which may be fixed to the fixed contact 10.

In step S3, the movable contact body and the fixed contact body are placed within the cavity of the contact support 12, and a predetermined distance, i.e. the contact distance is remained between the movable contact body and the fixed contact body.

In step S4, the left arc-extinguishing chamber 2 and the right arc-extinguishing chamber 9 are fixed respectively on both sides opposite to each other of the movable and fixed contact bodies, and a predetermined distance is remained between the arc-extinguishing chambers and the arc ignition sheets 5 for the movable contact and the arc ignition sheets 11 for the fixed contact.

Through the above method, the contactor 100 shown in FIG. 1 may be manufactured. It should be noted that it is unnecessary to implement the above steps in the above order, and some steps, for example, steps S1 and S2 may be implemented in an inverse order or in parallel.

Objects, technical solutions and advantages of the present disclosure are described in detail in the above specific embodiments. It should be appreciated that the above described contents are merely specific embodiments of the present disclosure and are not intended to limit the present disclosure. Any modifications, alternatives and improvements, which are made to the present disclosure without departing from the spirit and principle of the present disclosure, will fall within the scopes of the present disclosure.

What is claimed is:

1. A contactor, comprising:

a fixed contact (10);

a movable contact (3) capable of moving towards or away from the fixed contact (10);

two arc ignition sheets (5) for the movable contact, being positioned respectively at two sides opposite to each other of the movable contact (3) in a first direction and fixed and electrically connected to the movable contact (3);

two arc ignition sheets (11) for the fixed contact, being positioned respectively at two sides opposite to each other of the fixed contact (10) in the first direction and fixed and electrically connected to the fixed contact (10); and two arc-extinguishing chambers (2, 9) being arranged respectively on extension lines extending from the movable contact (3) to the two arc ignition sheets (5) for the movable contact in the first direction, wherein the two arc ignition sheets (5) for the movable contact form an incomplete encirclement for the movable contact (3) and the incomplete encirclement has a gap in a direction substantially orthogonal to the first direction.

2. The contactor of claim 1, further comprising a contact support (12) provided with a cavity therein, wherein the movable contact (3) and the fixed contact (10) are arranged in the cavity.

3. The contactor of claim 2, wherein the cavity is provided with a guide groove, along which the movable contact (3) moves towards or away from the fixed contact (10).

4. The contactor of claim 3, wherein the arc ignition sheets (5) for the movable contact are provided with a bump cooperating with the guide groove to enable the movable contact (3) move along the guide groove.

5. The contactor of claim 1, wherein the arc ignition sheets (5) for the movable contact and/or the arc ignition sheets (11) for the fixed contact are made of magnetic materials.

6. The contactor of claim 1, wherein the arc ignition sheets (5) for the movable contact are provided with a structure (54) matching with an outer shape of the movable contact (3).

7. A contactor, comprising:

a fixed contact (10);

a movable contact (3) capable of moving towards or away from the fixed contact (10);

two arc ignition sheets (5) for the movable contact, being positioned respectively at two sides opposite to each other of the movable contact (3) in a first direction and fixed and electrically connected to the movable contact (3);

two arc ignition sheets (11) for the fixed contact, being positioned respectively at two sides opposite to each other of the fixed contact (10) in the first direction and fixed and electrically connected to the fixed contact (10);

two arc-extinguishing chambers (2, 9) being arranged respectively on extension lines extending from the movable contact (3) to the two arc ignition sheets (5) for the movable contact in the first direction; and a contact support (12) provided with a cavity therein, the movable contact (3) and the fixed contact (10) being arranged in the cavity.

8. The contactor of claim 7, wherein the cavity is provided with a guide groove, along which the movable contact (3) moves forwards or away from the fixed contact (10), and the arc ignition sheets (5) for the movable contact are provided with a bump cooperating with the guide groove to enable the movable contact (3) move along the guide groove.

9. A contactor system comprising:

the contactor of claim 1; and a control device for controlling the contactor to be closed or opened.

10. The contactor system of claim 9, wherein the control device comprises:

a movable core (16) connected to the contact support (12);

a fixed core (13);

a control coil (14), the energizing and deenergizing of which is controlled from external of the contactor system; and a reaction spring (15), wherein the reaction spring (15) keeps a distance between the movable core (16) and the fixed core (13) when the control coil (14) is not energized, and the movable core (16) and the fixed core (13) are connected with each other when the controller coil (14) is energized.

* * * * *